United States Patent [19]

Barnes et al.

[11] 4,365,803

[45] Dec. 28, 1982

[54] GAME TABLE

[75] Inventors: George A. Barnes, Seattle, Wash.; Walter J. Sirois, Beaverton, Oreg.

[73] Assignee: Victory Games, Inc., Issaquah, Wash.

[21] Appl. No.: 221,525

[22] Filed: Dec. 31, 1980

[51] Int. Cl.[3] ..... A63D 15/00

[52] U.S. Cl. ..... 273/5 R; 273/3 B; 273/3 C; 273/11 R; 273/126 R

[58] Field of Search ..... 273/2, 3 R, 3 C, 8, 273/9, 11 R, 11 C, 3 B, 5 R; 108/153, 157, 901, 902; 52/309.7

[56] References Cited

U.S. PATENT DOCUMENTS

| | | | |
|---|---|---|---|
| 122,830 | 1/1872 | Heyl . | |
| 211,083 | 1/1879 | Bensinger . | |
| 653,727 | 7/1900 | Zentner . | |
| 747,726 | 12/1903 | Karham . | |
| 3,180,642 | 4/1965 | Reineman | 273/3 |
| 3,319,958 | 5/1967 | Bender | 108/153 X |
| 3,337,216 | 8/1967 | Miller et al. | 273/3 |
| 3,399,890 | 9/1968 | Galedrige | 273/6 |
| 3,455,551 | 7/1969 | Untiedt | 273/6 |
| 3,584,872 | 6/1971 | Nielsen | 273/3 |
| 3,824,933 | 7/1974 | Lind | 108/902 X |
| 3,854,783 | 12/1974 | Teranishi | 108/153 X |
| 3,871,655 | 3/1975 | Zimmers et al. | 273/3 C X |

FOREIGN PATENT DOCUMENTS

| | | | |
|---|---|---|---|
| 623554 | 8/1961 | Italy | 273/3 R |

*Primary Examiner*—Richard C. Pinkham
*Assistant Examiner*—T. Brown
*Attorney, Agent, or Firm*—Graybeal & Uhlir

[57] ABSTRACT

A game table (20) includes a bed assembly (22) mounted on a frame (100) to rotate about its longitudinal, central axis. Table frame (100) is constructed from hollow side structures (102) each composed of a thin walled outer shell (106) joined together with a thin walled inner shell (108). Side structures (102) are transversely interconnected with hollow end structures (300) each composed of a thin walled outer shell (302) permanently joined with a thin walled inner shell (304). In addition to supporting bed assembly (22), side structures (102) include portions which serve as ball return runs (160) and (162) for directing balls dropping into corner and side pockets (30) and (32) into a storage compartment (165). Hollow leg body members (114), which depend downwardly from side structures (102), can be filled with ballast once table (20) has been assembled. The ballast can be removed when desired to transport table (20) to a new location.

28 Claims, 13 Drawing Figures

GAME TABLE

TECHNICAL FIELD

The present invention relates to game tables, and more particularly to a pool table having a bed rotatably mounted on a surrounding frame structure composed of moulded side structures with a ball return run and a ball storage compartment integrally formed in side rail and apron portions of the side structures.

BACKGROUND ART

The prior art discloses pool, billiard and other types of game tables having beds adapted to rotate about a longitudinal, central axis to thereby utilize both surfaces of the bed to play a different type of game on each surface. In U.S. Pat. No. 122,830, a bed is pivotally mounted on two end support members interconnected together by longitudinal stretchers disposed at an elevation below the bed. The bed is theoretically held level by elongate braces extending upwardly from the base of the end supports. The braces are clamped to the bed by thumbscrews extending through slots formed in the upper end of each brace and engaging into threaded openings formed in the end portions of the bed. Tremendous clamping pressure must be applied by the thumbscrews to securely hold the bed level.

In U.S. Pat. No. 211,083 a bed pivots on pins which are journaled in end frame members. A square headed lug, engaged over the pin, is secured to the end edge of the bed to engage within a correspondingly shaped socket formed in the end frame. The table is orientated by rotating it until the lug fits within the socket and then the screw is tightened. Because of the relatively small size of the lug socket relative to the width of the table, any minor variation in the size or orientation of the lug or socket can result in a significant variation in the angular orientation of the table. Also, the load imposed on the side of the table, for instance by someone leaning against it, must be carried by the rather small lug and socket.

In U.S. Pat. No. 653,727, a rotating bed, pivotally mounted on a tube extending between two standards, is angularly orientated by a conical plug extending longitudinally inwardly from one standard into a socket formed in the end portion of the bed.

U.S. Pat. No. 747,726 discloses a combination billiard and pool table having end and side pockets integrally formed with the bed. The table is mounted on a surrounding perimeter frame to rotate about an axis extending longitudinally centrally of the table. The table is held by a pin which extends transversely inwardly from one side of the frame to engage within a socket embedded within the corresponding side of the bed. In this particular patent, and all of those discussed above, the bed must be rotated by pushing down on one side or lifting up on the opposite side of the bed. No mechanism is disclosed for rotating the bed in a safe, controlled manner.

In known pool tales, various types of rails, aprons, ball return runs, and ball storage compartment structures are found. In U.S. Pat. No. 3,455,551, a ball return run is constructed as part of, and is disposed along each side edge of, a bed assembly. A rail assembly, separate from the ball return run, is mounted on the top surface of the bed. A ball storage compartment is located at one end of the table.

In U.S. Pat. No. 3,180,642, a downwardly open groove is formed along the underside of the portion of the outer edge of a rail which extends outwardly beyond the side of a bed top. A tongue, which is affixed to the upper edge portion of a downwardly depending apron, is engaged within the rail groove to releasably interlock the apron with the rail.

In U.S. Pat. No. 3,337,216, rather wide aprons are spaced outwardly from the edges of a pool table bed by brackets affixed to the marginal portions of the table. Ball return chutes are secured to the side edges of the table bed. Each chute includes an outer flange member which engages within a recess formed along the length of a corresponding apron to thereby interconnect the apron with the ball return chute. The pool table disclosed by this particular patent, and all of those discussed above, utilize a large number of wooden components which tend to expand and contract in response to changes in climatic conditions, such as humidity, possibly tending to alter precisely the adjustment of the table.

U.S. Pat. No. 3,584,872 discloses a pool table bed mounted on a steel frame composed of a rather large number of truss members. Individual ball return chutes and aprons are mounted on the sides of the steel bed frame. This particular type of construction results in a rather heavy pool table which is more expensive and cumbersome to transport than a table which weighs less. Moreover, this pool table and all of those discussed above, are composed of a large number of components which must be accurately manufactured if the table is to be assembled properly.

U.S. Pat. No. 3,399,890 concerns a diamond-shaped pool table constructed with a hollow frame which can be filled with loose ballast, such as sand. This particular table is not adapted to rotate about its longitudinal axis so that both surfaces of the bed can be utilized to play different types of games.

DISCLOSURE OF INVENTION

In accordance with the present invention, I provide a combination pool and game table having a bed which is rotatably mounted on a surrounding frame structure composed of a minimum number of components which can be readily assembled and disassembled and conveniently transported from place to place and then reassembled without requiring special tools or skills. To this end, the table frame structure includes a pair of hollow side structures each composed of a thin walled outer shell and a thinned walled inner shell assembled together to form an integral side rail, side apron, ball return run and ball storage compartment thereby providing the advantage that all these portions of a conventional pool table are built into a single unitary side structure. The table frame also includes a pair of hollow end structures each composed of an outer shell and an inner panel fixedly assembled together to form an integral rail and apron structure. The end structures also house a mechanism used to rotate the table about its longitudinal central axis. An important advantage of the invention is that the table frame is constructed from very few components thus minimizing the expense of its manufacture and assembly.

Also in the present invention, table latch assemblies for preventing rotation of the table are mounted in the edge portions of the table bed to engage with catch plates mounting on the frame side structures. By locating the latch mechanism in this manner, as far as possible away from the rotational axis of the bed, a minimum amount of force must be carried by the latch assemblies to hold the bed stationary. Moreover, the catch plates are vertically adjustable so that the table bed can be very accurately leveled.

Each table frame side structure is constructed with large connection flanges which are bolted in face-to-face relationship with correspondingly sized end caps disposed at each end of the end structures. This particular construction enables the side and end structures to be readily assembled together into precise relationship so that very little if any further adjustment is required. This leads to the advantage that an individual consumer can easily assemble a pool table and thus does not have to hire a skilled workman to properly adjust the table.

Hollow leg members are integrally constructed with the side structures. An inside cover panel can be attached to the legs after they have been filled with ballast, such as sand or concrete. By adding ballast to the legs, the weight of the table is increased while the vertical center of gravity is lowered thereby greatly improving the stability of the table. In conventional tables, the bed is made of heavy components, such as slate which places considerable stress on the connection between the top of the legs and the table frame. This problem is avoided by the construction of applicant's table frame legs.

BEST MODE FOR CARRYING OUT THE INVENTION

Figure 2:
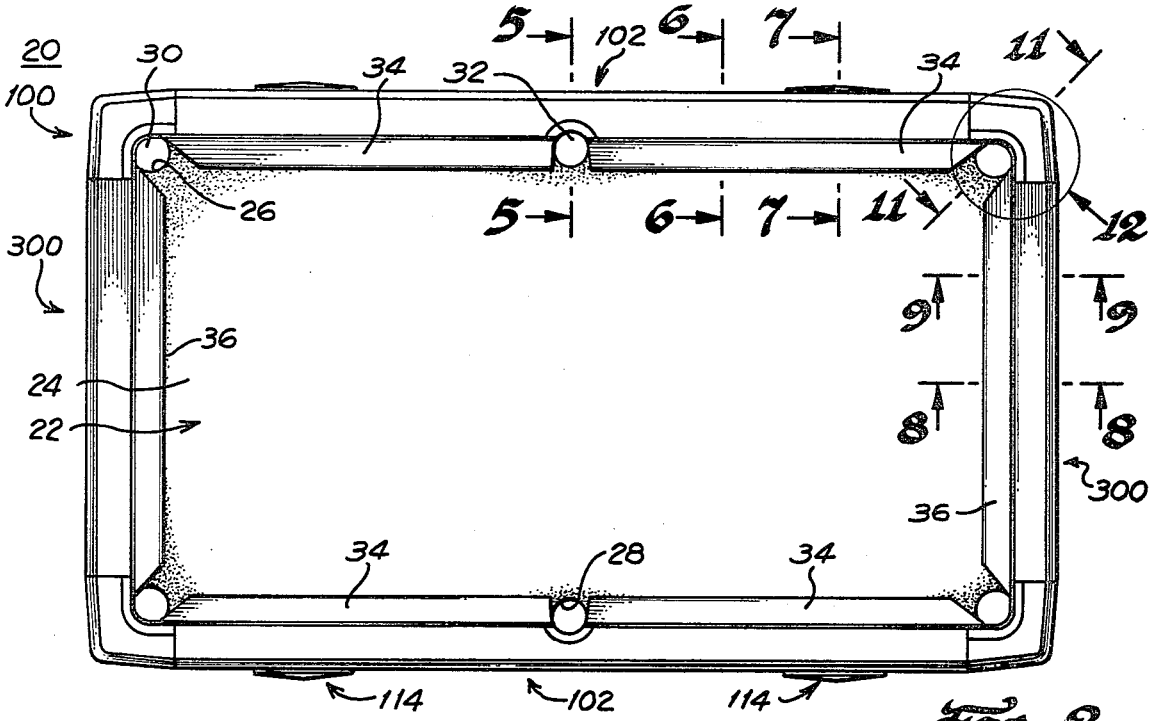
FIG. 2 is a plan view of the typical game table illustrated in FIG. 1.
Figure 3:
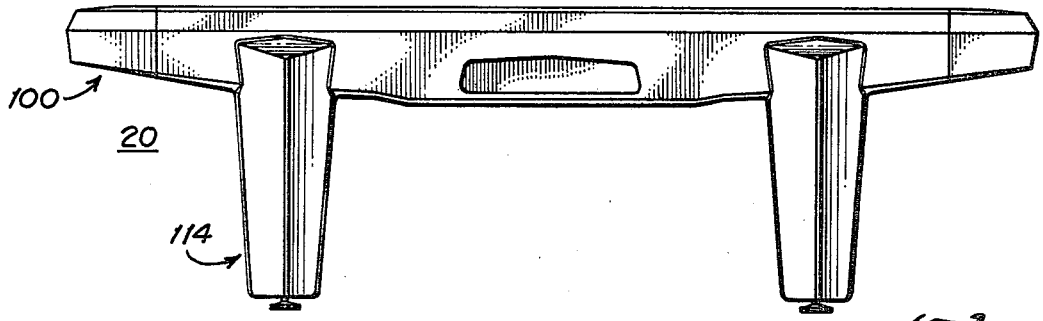
FIG. 3 is a side elevational view of the typical game table illustrated in FIGS. 1 and 2.
Figure 4:
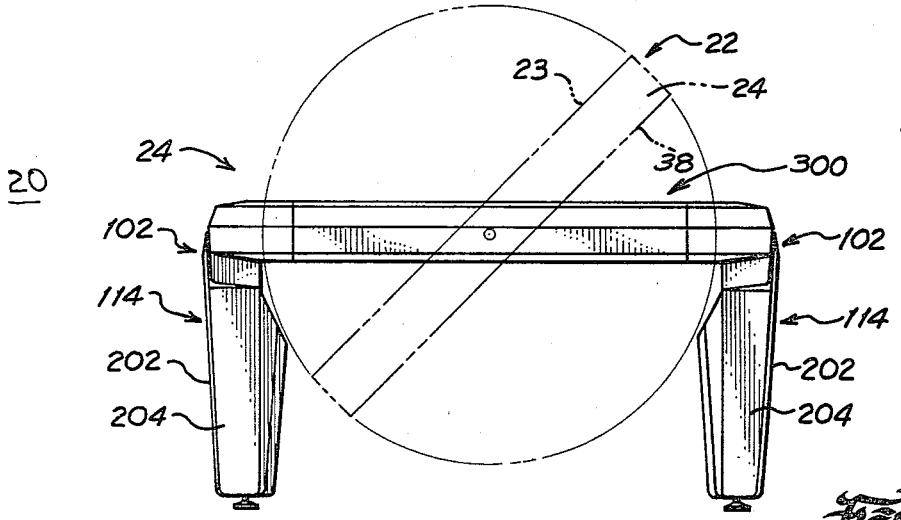
FIG. 4 is an end elevational view of the typical game table illustrated in FIGS. 1–3 with the bed assembly disposed in diagonal orientation.

Referring initially to FIGS. 2–4, a game table 20 constructed according to the best mode of the present invention basically comprises a bed assembly 22 rotatably mounted on a surrounding table frame 100. Bed assembly 22 includes a rectangularly shaped bed 24 having a face 23 adapted for playing pool. Accordingly, arcuate corner notches 26 and arcuate side notches 28 are formed in face 23 to serve as the corner and side pockets 30 and 32, respectively, of table 20. This same side of bed 24 is covered with a felt material in the manner of a traditional pool table. Moreover, cushions 34 are mounted on the side margins of face 23 to extend between each corner notch 26 and a corresponding side notch 28. Similarly, end cushions 36 extend between corner notches 26. Side cushions 34 and end cushions 36 can be attached to bed 24 in any convenient manner, such as through the use of screws or bolts (not shown). As shown best in FIG. 2, the ends of cushions 34 and 36 are mitered to provide the correct angular relationship with corresponding pockets 30 and 32.

The opposite face 38 of bed 24 can be adapted for playing games other than pool. For instance, this surface can be given a smooth finish so that it can be used to play a shuffleboard type of game.

Figure 1:
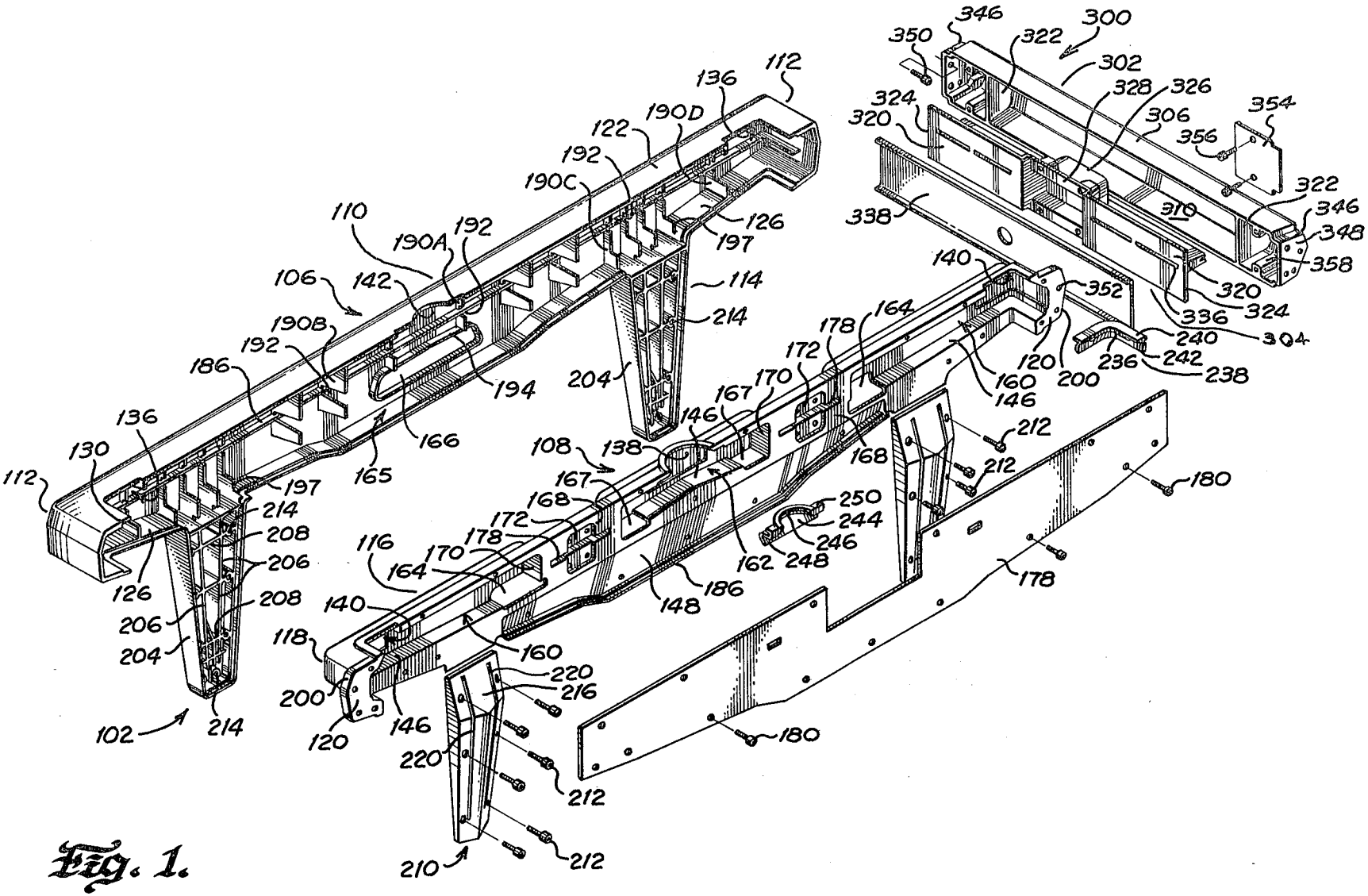
FIG. 1 is a fragmentary, exploded, isometric view of portions of the frame portion of a typical game table constructed according to the present invention.

Next referring to FIGS. 1 and 5–9, table frame 100 includes elongate side structures or frames 102 extending along each side of bed assembly 22 and a short distance around the corners of the bed assembly to intersect elongate, generally straight end structures 300, thereby closely encircling the bed assembly. As best illustrated in FIGS. 1 and 5–7, preferably each side structure 102 is composed of an outer shell 106 and an inner shell 108 joined together to form a hollow, but rigid construction. As illustrated in FIG. 1, shells 106 and 108 are both formed from relatively thin walls and in rather complex shapes which enables them to cooperatively perform many pool table functions, as described more fully below. For reasons of strength and ease and economy of construction, ideally shells 106 and 108 are moulded from foamed plastic material.

As best shown in FIG. 1, each outer shell 106 includes a longitudinal portion composed of an elongate side section 110 which extends along the length of bed assembly 22 and corner sections 112 at each end of side section 110, which corner sections extend transversely inwardly a short distance along the ends of bed assembly 22. Outer shell 106 also includes a pair of spaced apart leg body portions 114 which extend downwardly from side section 110. In a manner analogous to outer shell 106, inner shell 108 includes an elongate side section 116 corresponding to outer shell side section 110 and corner sections 118 at each end of elongate section 116 which extend along outer shell corner sections 112. Inner shell 108 also includes connection flanges 120 which are attached to the free ends of and extend transversely to each corner section 118 to lie in a common, vertical plane.

The side and corner sections 110 and 112 of outer shell 106 include an upper rail wall 122 which slopes slightly transversely away from bed assembly 22 starting from an elevation corresponding to the upper surface of cushions 34 and 36 to intersect with a compound shaped outer apron wall 124 that initially slopes downwardly and diagonally outwardly from upper rail wall 122 and then extends essentially vertically downwardly and slightly inwardly toward inner shell 108 to intersect with the outer edge portion of an outer base wall 126. Outer base wall 126 extends inwardly and slightly downwardly from outer wall 124 to intersect with inner shell 108. An arcuate side notch 142 and two arcuate corner notches 136 are formed in upper rail wall 122 at locations corresponding to notches 28 and 26, respectively, of bed 24 to cooperatively form side pocket 32 and corner pockets 30, FIG. 1.

Figure 5:
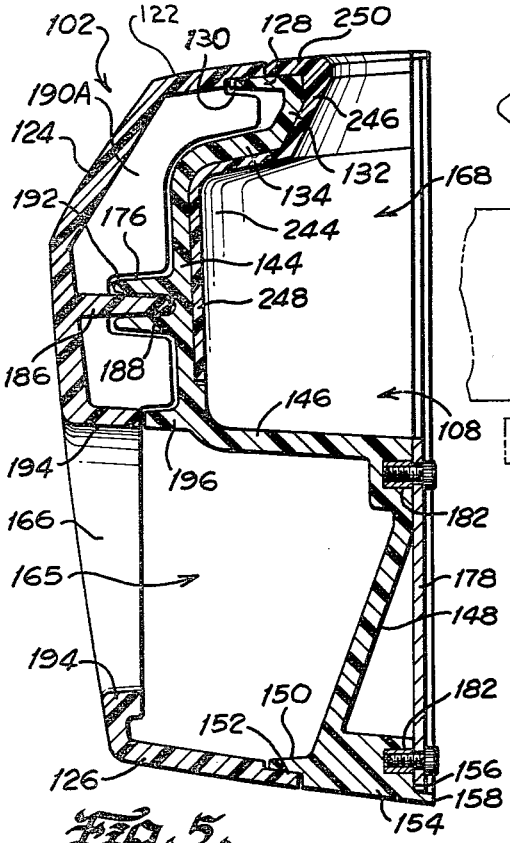
FIG. 5 is an enlarged cross-sectional view of the typical game table illustrated in FIG. 2, taken substantially along lines 5—5 thereof, specifically illustrating the construction of the table frame at a side pocket.
Figure 7:
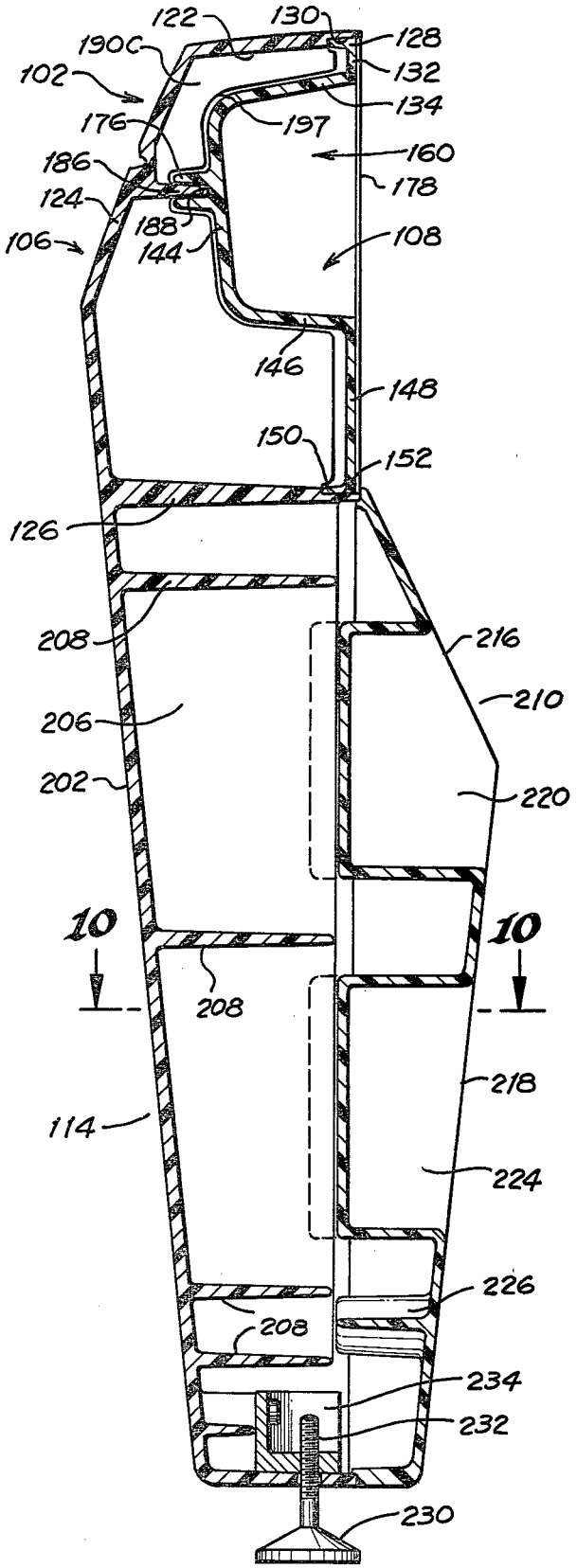
FIG. 7 is an enlarged cross sectional view of the typical game table illustrated in FIG. 2, taken substantially along lines 7—7 thereof, specifically depicting the construction of a leg body assembly.

As best illustrated in FIGS. 1, 5 and 7, inner shell 108 includes an upper side wall 132 having a generally horizontally disposed upper lip portion 128 which engages with an underlying notch 130 formed along the edge portion of upper rail wall 122. Upper side wall 132 extends vertically downwardly a short distance from lip 128 to intersect with a sloped lower rail wall 134 which extends outwardly and slightly downwardly from the lower edge of upper side wall 132 toward outer shell 106 to underlie upper rail wall 122. As best illustrated in FIG. 1, corner notches 140 and a center notch 138 are formed in lower rail wall 134 at locations corresponding to corner pockets 30 and center pocket 32, respectively. As illustrated in FIG. 5, in the region of notches 140 and 138, rather than being vertical, upper side wall 132 is sloped downwardly and outwardly.

Inner shell 108 further includes an inner apron wall 144 which extends generally vertically downwardly and slightly inwardly from lower rail wall 134 to intersect with a ball run base wall 146. Wall 146 extends generally transversely inwardly and slightly downwardly from the lower edge of inner apron wall 144 to intersect with the upper edge portion of a lower side wall 148, which lower side wall extends downwardly to terminate at a generally horizontally disposed lower lip 150 that engages with a correspondingly shaped notch 152 formed in the upper surface of the adjacent edge portion of base wall 126. Although lower side wall 148 extends generally vertically downwardly along each end portion of inner shell 108, it extends downwardly and transversely outwardly toward outer apron wall 124 along the central portion of inner shell 108, i.e. the portion extending between leg body portions 114. An inner base wall 154 extends transversely inwardly and slightly downwardly from the central section of the lower edge portion of lower inner wall 148 in a direction opposite to lower lip 150 to thereby form a continuation of outer base wall 126. Wall 154 terminates at an edge 156 which is flush with the inwardly directed faces of upper side wall 132 and lower side wall 148. Inner base wall 154 includes an inner lip portion 158 that extends a short distance transversely inwardly beyond edge 156.

As illustrated best in FIG. 7, upper apron wall 122, upper vertical wall 132, and lower apron wall 134 cooperate together to form a hollow rail portion of table 20 which closely encircles bed assembly 22. Also, outer apron wall 124 and inner apron wall 144 cooperate together to form an apron for table 20 integral with a corresponding rail portion. Referring additionally to FIGS. 1 and 5, lower rail wall 134, inner apron wall 144 and ball run base wall 146 cooperate together to form the top, outside and bottom walls of end ball runs 160 and a center ball run 162 which are in communication with corner pockets 30 and center pocket 32, respectively. The inside walls of ball runs 160 and 162 are formed by the adjacent edge portion of bed 24.

As best shown in FIG. 1, in each end ball run 160, base surface 146 is inclined in a direction longitudinally away from corner pockets 30 to terminate at an opening 164 formed in the ball run base wall. Each end ball run 160 serves to direct balls dropping into corner pockets 30 away from such pockets toward the longitudinal center of side structure 102 and down through opening 164 into a ball storage compartment 165 disposed beneath the ball runs. Storage compartment 165 is formed at the longitudinal center area of side structures 102 by ball run base wall 146, outer apron wall 124, outer base wall 126 and lower side wall 148, FIG. 5. As most clearly shown in FIG. 1, outer base wall 126 slopes downwardly toward the longitudinal center of side structure 102 from each leg body portion 114 to terminate at a slightly centrally sloped central section which forms the bottom surface of storage compartment 165. In the region of storage compartment 165, outer apron wall 124 and lower side wall 148 extend downwardly to the depressed level of outer base wall 126. An opening 166 is formed in outer apron wall 124 to provide access to storage compartment 165. Ball run base wall 146 also slopes downwardly in both longitudinal directions away from center pocket 32 to terminate at openings 167 formed in the ball run base wall to thereby direct balls dropping into center pocket 32 through openings 167 and into storage compartment 165.

Figure 6:
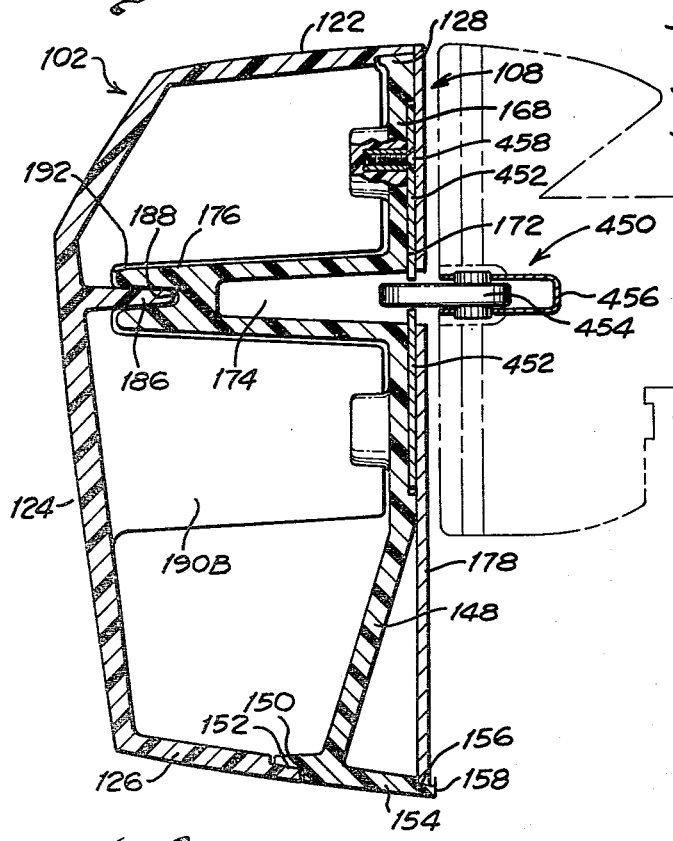
FIG. 6 is a cross-sectional view of the typical game table shown in FIG. 2 taken substantially along lines 6—6 thereof specifically illustrating the construction of a bed latch assembly.

As best illustrated in FIGS. 1 and 6, the portions of inner shell 108 extending between ball run end openings 164 and an adjacent center ball run opening 167 is constructed differently than the remainder of the inner shell. At these locations, the inner shell does not include a lower rail wall 134, an inner apron wall 144 or a ball run base wall 146; instead, an inner face wall 168 extends vertically downwardly from upper lip 128 to intersect lower side wall 148. A vertically disposed end wall 170 extends transversely outwardly from each end of each inner face wall 168 to intersect with inner apron wall 144, FIG. 1. A rectangularly shaped shallow recess 172 is formed in the side of each inner face wall 168 adjacent bed assembly 22. A horizontally elongate slot 174 is formed in each inner face wall 168 to extend longitudinally beyond each side of recess 172. Slot 174 extends transversely outwardly beyond inner face wall 168 into a groove member 176 extending transversely outwardly of the side of inner face wall 168 facing outer shell 106.

Because of the rather large size of inner and outer shells 106 and 108, and because of their relatively thin wall construction, it is preferable that stiffening or reinforcing means be utilized to increase the rigidity and strength of side structure 102. This in part is accomplished by securely attaching an elongate, flat side stiffener plate 178 to the inside surface of each inner shell 108. As best illustrated in FIG. 1, stiffener plate 178 is contoured to correspond to the profile of inner shell 108 and includes a rectangularly shaped central notch to provide clearance at the region of center ball run 162. Stiffener plate 178 is securely attached in face-to-face relationship thereto by a plurality of capscrews 180 extending through clearance holes provided in the stiffener plate to engage within threaded inserts 182 embedded within upper side wall 132, lower side wall 148 and inner base wall 154. Threaded metal inserts 182 are required since if threads are formed directly in the foam plastic material from which outer and inner shells 106 and 108 are ideally formed, the threads may not have enough strength to adequately torque capscrews 180. Side stiffener plate 178 is initially vertically located by lip 158 extending along the lower edge of inner shell 108. Stiffener plate 178 is ideally constructed of high strength material such as metal, plastic laminate or fiberglass.

Side structures 102 are further strengthened by a horizontally disposed side tongue strip 186 which extends along the length of and inwardly from outer apron wall 124 towards inner shell 108 to engage within a correspondingly shaped, horizontally disposed side groove 188 formed by a groove member 176 extending along apron inner wall 144 and inner face walls 168, FIGS. 1 and 5–7. Because the width of side tongue strip 186 is substantially constant along its length, the width of side groove member 176 is necessarily wider along inner face wall 168 than along inner apron wall 144. It will be appreciated that tongue strip 186 and groove member 176 cooperate together to prevent side structures 102 from bending, buckling, or otherwise failing while supporting game table 20.

Further stiffening of side structures 102 is provided by a series of thin, vertically disposed stiffener plates 190 extending downwardly from upper rail wall 122 and transversely from outer apron wall 124 towards inner shell 108. Each of the stiffener plates 190 includes an upper section disposed above tongue strip 186 and a lower section disposed below the tongue strip separated by central notch 192 for providing clearance for groove member 176. As best illustrated in FIG. 1, two stiffener plates 190A are disposed above storage compartment opening 166, with the lower edge of such two plates abutting downwardly against an inwardly directed lip 194 formed around the perimeter of opening 166 and against a ledge 196 extending horizontally towards lip 194 from the intersection of inner apron wall 144 and ball run base wall 146.

Two stiffener plates 190B are also located along inner face wall 168, as illustrated in FIGS. 1 and 6. The free edges of these particular stiffener plates terminate just short of the adjacent surface of inner face wall 168. As most clearly illustrated in FIGS. 1 and 7, four stiffener plates 190C are located adjacent each leg body portion 114 with the free edges 197 of such plates shaped to correspond to the contour of the adjacent portion of inner shell 108, FIG. 7. Additionally, a single stiffener plate 190D is located adjacent outer shell corner notch 136 to extend the full height separating outer base wall 126 and upper rail wall 122. It will be appreciated that if deemed necessary, additional stiffener members 190 can be added to outer shell 106 to further strengthen side structure 102.

Referring to FIGS. 1 and 2, side structures 102 include rather thick, flat connection flanges 120 formed at the free ends of inner shell corner sections 118. Mounting flanges 120 are disposed transversely to corner sections 118 in a common vertical plane recessed slightly from the free edges of outer shell corner sections 112. The outer edges 200 of each flange 120 are shaped to correspond to the inside contour of corner sections 112 to thus closely mate with corner sections 112 when the inner and outer shells are assembled together. It will be appreciated that rather than being formed integrally with inner shell corner sections 118, connection flanges 120 could instead be formed as a separate member and then assembled with outer and inner shells 106 and 108.

Figure 10:
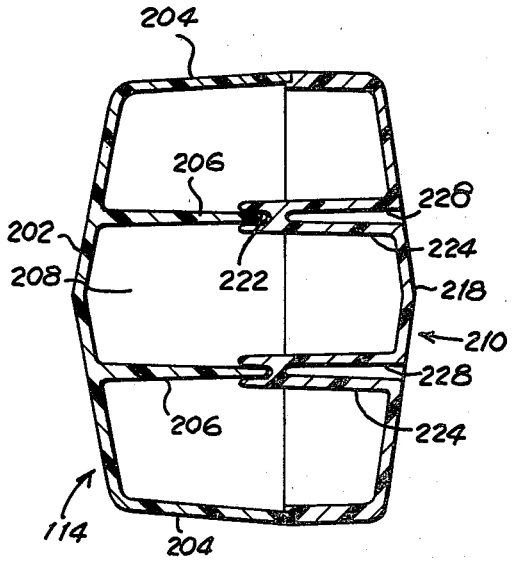
FIG. 10 is an enlarged cross-sectional view of the leg body assembly illustrated in FIG. 7 taken substantially along lines 10—10 thereof.

Each side structure 102 also includes a pair of longitudinally spaced apart leg body members 114 integrally formed with and extending downwardly from outer shell 106, FIGS. 1, 7 and 10. Each leg body 114 includes an exterior side wall 202 formed as an extension of apron outer wall 124 and a pair of transverse walls 204 extending transversely to wall 202. Transverse walls 204 converge towards each other in the downwardly direction to form leg body portions 114 in a tapered profile, FIG. 1. Leg body members 114 are strengthened by a pair of vertical stiffening walls 206 and a plurality of horizontally disposed vertically spaced apart walls or webs 208 which extend between transverse walls 204 and adjacent vertical stiffening walls 206 and between the two vertical stiffening walls 206. Each leg body member 114 is closed by a contoured cover 210 which is detachably secured to the leg body member by a plurality of threaded fasteners 212 extending through clearance holes provided in cover 210 to engage with threaded inserts 214 embedded within leg body members 114. As best shown in FIG. 4, the outer surface of cover 210 is not flat but includes an upper portion 216 which is sloped downwardly and transversely inwardly toward the longitudinal center of table 20 and a longer lower portion 218 which is sloped downwardly and transversely outwardly toward leg body portion 114. This particular contour is designed to provide clearance for the edge of bed assembly 22 as it rotates about its longitudinal axis, FIG. 4.

Cover 210 includes a pair of vertical, upper groove members 220 extending transversely from cover portions 216 and 218 towards leg exterior side wall 202. A groove 222 is formed in the free edge portion of members 220 to engage with the adjacent edge portions of vertical stiffening walls 206 to thereby stiffen leg body member 114. Cover 210 further includes a pair of intermediate groove members 224 and a pair of lower groove members 226 constructed similarly to upper groove members 220. Intermediate and lower groove members 224 and 226 are also formed with a vertical groove 222 extending along their free edges for engaging an adjacent free edge of vertical stiffening wall 206 to further reinforce leg body members 114. As illustrated in FIG. 10, each of the groove members 222, 224 and 226 includes a relatively deep exterior groove or depression 228 extending inwardly from the outer surface of cover 210 so that the walls of the groove members are approximately the same thickness as the thickness of cover 210 itself, thus facilitating the manufacture of cover 10 by, for instance, an injection moulding process. It is to be understood that if a different manufacturing technique is used to form cover 10, it may be possible to eliminate exterior grooves 228.

Referring to FIGS. 3, 4 and 7, each leg body member 114 includes a vertically adjustable foot member 230 having a threaded stem portion 232 engageable with a bracket 234 securely affixed to the interior of the leg body member by any convenient means, such as by bolting. The relative engagement between stem 232 and bracket 234 can be varied to alter the height or standout of foot member 230 to thereby level table 20.

Leg member 114 can be filled with ballast to increase the weight of table 20. An opening, not shown, can be provided in leg body member 114 so that the leg can be filled with loose ballast, such as sand, once table 20 has been assembled. Alternatively, an inner container, not shown, can be filled with heavy material, such as sand or concrete, and then the interior container placed within leg body member 114. In either alternative, it is contemplated that the ballast could be readily removed from the leg body member so that table 20 can be conveniently moved from one location to another. The weight of the ballast reduces the likelihood that the table will shift during use and also stabilizes the table by reducing its center of gravity. Moreover, the ballast does not increase the stresses at critical locations, such as at the juncture of leg body members 114 with side structures 102 as would occur if the table was stabilized by constructing the bed assembly from heavy materials.

Figure 11:
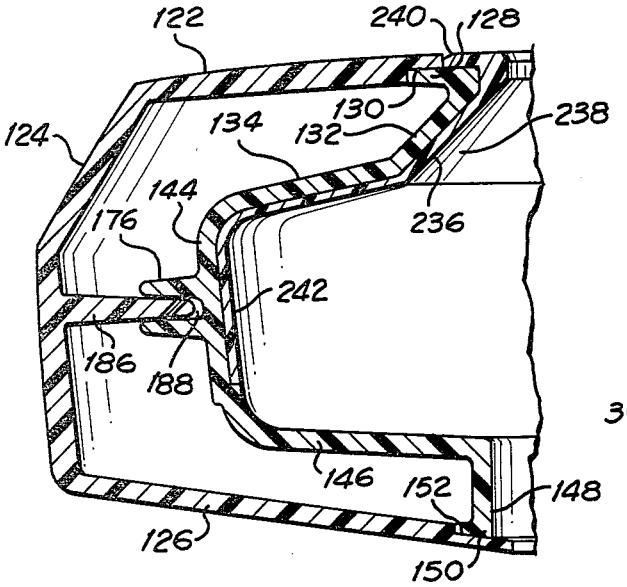
FIG. 11 is an enlarged cross-sectional view of the typical game table illustrated in FIG. 2 taken substantially along lines 11—11 thereof specifically depicting the construction of the table frame at a corner pocket.
Figure 12:
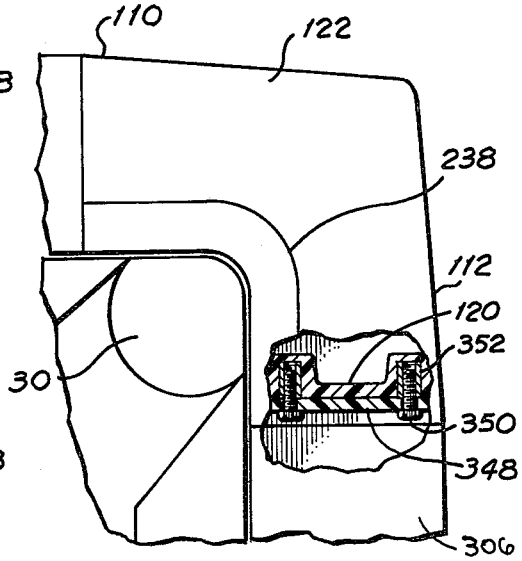
FIG. 12 is a fragmentary, enlarged plan view specifically illustrating the juncture between the table frame side and end structures.

As most clearly illustrated in FIGS. 1 and 11, inner shell 108 includes a corner notch 140 formed in lower rail wall 134 at the intersection of shell elongate section 116 and shell corner section 118. Upper rail wall 122 and lower rail wall 134 are relieved in the area of corner notch 140. The portion of upper side wall 132 located in the relieved area of upper and lower rail walls 122 and 134 underlies a correspondingly shaped upper section 236 of a corner pocket liner 238. Corner pocket liner 238 is formed generally in the shape of a right angle, with an upper flange 240 disposed transversely to the upper edge portion of upper section 236 to overlie the corresponding portion of upper lip 128. As best shown in FIG. 11, the upper surface of flange 240 is essentially flush with the upper surface of apron upper wall 122. Pocket liner 238 also includes a lower section 242 which overlies corresponding portions of lower rail wall 134 and inner apron wall 144. Preferably pocket liner 238 is constructed from a resilient, shock absorbant material, such as polyethylene, polyurethane or natural or synthetic rubber to thereby absorb the shock and impact loads imparted on side structure 102 when a ball enters corner pocket 30.

Each side pocket 32 also includes a side pocket liner 244 which serves the same function as corner pocket liners 238. As best shown in FIGS. 1 and 5, upper rail wall 122 and lower rail wall 134 are relieved in the area of said pocket 32 so that upper side wall 132 forms an arcuate notch 138 in the shape of a portion of a circle which underlies a correspondingly shaped upper section 246 of pocket liner 244. The underside of lower rail wall 134 and the adjoining surface of apron inner wall 144 are slightly relieved to underlie corresponding portions of liner lower section 248. Liner 244 also includes a flange 250 extending transversely to the upper edge of upper section 246 to overlie upper lip 128. The upper surface of flange 250 is substantially flush with the adjacent upper surface of upper rail wall 122.

Next referring to FIGS. 1, 2, 8 and 9, table frame 100 also includes a pair of elongate end structures 300 each composed of an outer end shell 302 of hollow, thin wall construction which mates with an inner end shell 304 also of thin wall construction to thereby form a hollow box section. Outer end shell 302 includes an end rail 306 sloping slightly downwardly away from an adjacent end of bed assembly 22 at an elevation corresponding to upper rail wall 122 of outer side shell 106 to thereby cooperate together to form a continuous upper surface for table frame 100. Outer shell 302 also includes an end apron wall 308 having a compound profile which initially slopes downwardly from the outer edge portion of end rail wall 306 in a direction longitudinally of bed assembly 22 and then extends downwardly and slightly back inwardly toward the bed assembly to intersect with the outer edge portion of an end base wall 310. As best illustrated in FIGS. 1 and 2, end apron wall 308 is sized and shaped to form a continuation of outer apron wall 124 of outer shell corner sections 112. End base wall 310 extends from the bottom edge portion of end apron wall 308 transversely and slightly downwardly toward bed assembly 22. Also referring to FIG. 9, the inside surfaces of the free edge portions of end rail wall 306 and end base wall 310 are slightly indented at 312 and 314, respectively, to receive upper and lower lips 316 and 318, respectively, of a vertical panel portion 320 of end inner shell 304. Panel portion 320 serves as an end apron inner wall in spaced complement to wall 308 which serves as an end apron outer wall. Outer end shell 302 also includes a pair of vertical divider walls 322 extending transversely to the length of outer shell 302 at a location outwardly adjacent the end edges 324 of vertical panel 320, which panel does not extend the full length of outer shell 302.

Vertical panel 320 is composed of two sections separated apart by a rectangularly shaped central housing 326 which is open in the direction facing bed assembly 22. Housing 326 includes upper and lower flanges 328 offset from the plane of panel 320 towards end apron wall 308. A relatively narrow, horizontally disposed tongue strip 330 extends along the inside surface of end apron wall 308 to engage within a correspondingly shaped groove 332 formed along the free edge portion of a groove member 334 extending horizontally from vertical panel 320, FIG. 9, and housing 326, FIG. 8. The portions of groove member 334 extending along vertical panel 320 includes a rather deep slot 336 dividing the groove member into an upper and lower wall of a thickness corresponding to the wall thickness of the vertical panel 320 and housing 326. Forming inner end shell 304 with a uniform wall thickness throughout is desirable when using an injection moulding or casting process to manufacture the shell. However, if other techniques are used to form inner shell 304, slots 336 may not be required.

Figure 9:
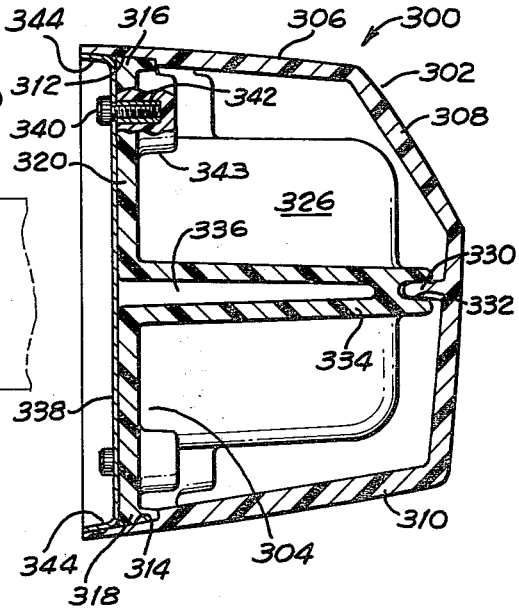
FIG. 9 is an enlarged cross-sectional view of the typical game table illustrated in FIG. 2, taken substantially along lines 9—9 thereof, specifically depicting the construction of the table frame end structure.

Further structural support for end structure 300 is provided by an elongate stiffener member 338 secured in face-to-face relationship with vertical panel 320 through the use of fasteners, such as capscrews 340, which extend through clearance holes provided in stiffener member 338 to engage within threaded metal inserts 342 imbedded within bosses 343 extending transversely from the side of vertical panel 320 in a direction opposite to stiffener member 338, FIG. 9. Stiffener member 338 includes upper and lower flanges 344 which contact against upper and lower end indentations 312 and 314 formed in end rail wall 306 and end base wall 310.

Next referring to FIGS. 1 and 2, an end cap plate 348 closes off each end of end structure outer shell 302. Each cap plate 348 is sized slightly smaller than the profile of outer shell 302 and is connected to the outer shell by a shoulder 346. Cap plate 348 is shaped and sized to slide within the corresponding outer shell corner section 112. Each cap plate 348 includes a plurality of clearance holes for receiving capscrews 350 which engage with threaded metal inserts 352 embedded within connection flanges 120 to thereby connect end structures 300 with side structures 102. The face-to-face contact between the rather large bearing areas of cap plate 348 and connection flanges 120 serves to properly align end structures 300 in transverse relationship with side structures 102. A removable cover plate 354 is provided to cover the portion of end structure outer shell 302 extending between divider wall 322 and cap plate 348 to thereby provide access to capscrews 350. Cover plate 354 is secured in place by capscrews 356 which extend through clearance holes provided in cover plate 354 and engage within threaded metal inserts, not shown, embedded within bosses 358 formed along the lower surface of end rail wall 306 and the upper surface of end base wall 310, FIG. 1.

Figure 8:
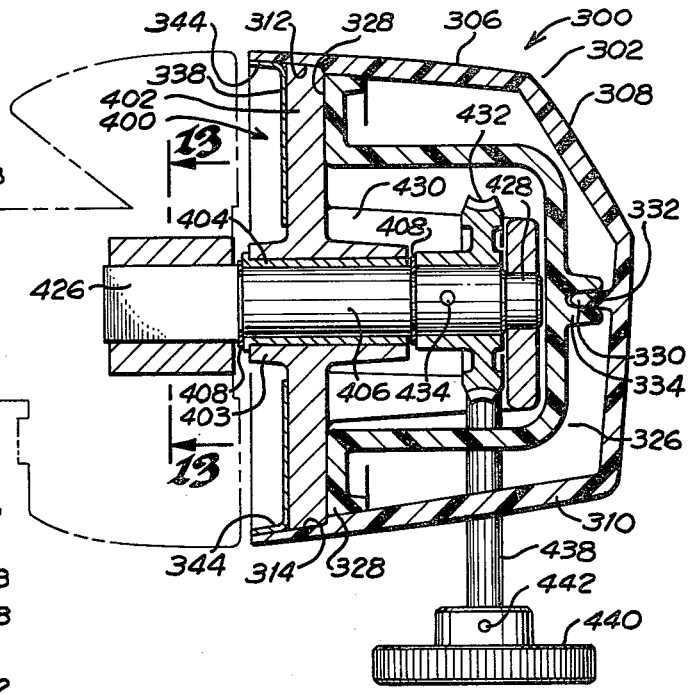
FIG. 8 is an enlarged cross-sectional view of the typical game table illustrated in FIG. 2, taken substantially along lines 8—8 thereof specifically illustrating the construction of the particular bed support assembly used to rotate the bed.
Figure 13:
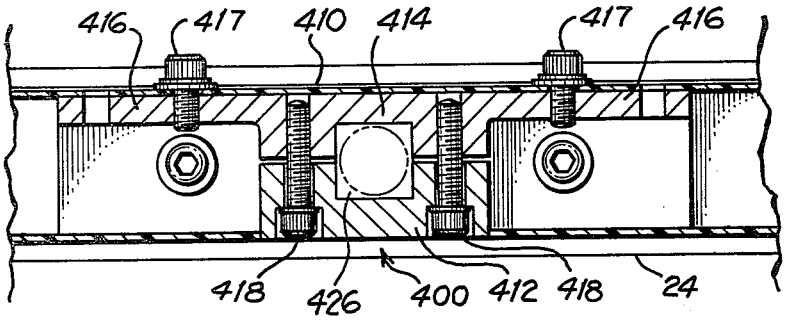
FIG. 13 is a fragmentary, enlarged cross-sectional view of the game table illustrated in FIG. 8, taken substantially along lines 13—13 thereof specifically illustrating the portion of the table support assembly attached to the bed.

Bed assembly 22 is mounted on table frame 100 with table support assemblies to rotate about the longitudinal center axis of bed 24. A support assembly 400 located at one end of table frame 100 includes a bushing plate 402 bolted to flanges 328 disposed along the upper and lower edges of housing 326, FIG. 8. Plate 402 has a central pilot hub 403 for snugly receiving a flanged housing 404 therein. As shown in FIG. 8, support assembly 400 includes a drive stub shaft 406 journaled within bushing 404 and retained therewith by a pair of snap rings 408, one at each end of bushing 404. Drive shaft 406 extends longitudinally from hub 403 along the rotational axis of bed assembly 22 to engage with upper and lower caps 410 and 412 attached to the adjacent end edge portion of bed 24, FIGS. 8 and 13. As shown best in FIG. 13, upper cap 410 includes a central neck portion 414 having a rectangularly shaped slot formed therein for partially receiving the square shaped end portion 426 of shaft 406. A pair of flanges 416 extend tranversely from neck portion 414. Upper cap 410 is secured to bed 24 by capscrews 417 which extend through clearance holes provided in flanges 416 to engage with threaded openings provided in bed 24. Lower cap 412 is constructed similarly to central neck portion 414 of upper cap 410 and also includes a rectangularly shaped slot for receiving shaft end portion 426. Lower cap 412 is bolted to upper cap 410 with capscrews 418 extending through countersunk clearance holes provided in the lower cap to engage with threaded through holes provided in upper cap 410. A reduced diameter end portion or tip 428 is formed at the end portion of drive shaft 406 opposite square end 426 to engage within a closely fitting opening formed within a U-shaped bracket 430 extending longitudinally of bushing plate 402 to thereby support the end of shaft 406. Bracket 430 is bolted to bushing plate 402 by capscrews, not shown.

A worm gear 432 is affixed to drive shaft 406 at a location between tip 428 and bushing 404 by a cross pin 434 extending through the hub portion of the gear and through shaft 406. Worm gear 432 meshes with a vertically disposed worm, not shown, affixed to the upper end of a vertical shaft 438 which extends downwardly through housing 326 and end base wall 310. A circularly shaped, manually graspable knob or handle 440 is attached to the lower end portion of shaft 438 by cross pin 442. Worm gear 432 is rotated by turning handle 440 to thereby power drive shaft 406 to in turn rotate bed assembly 22 about its longitudinal, central axis.

Another table support assembly, not shown, is disposed at the end of table 20 opposite support assembly 400. This support assembly is constructed similarly to assembly 400 with the exception that drive shaft 406 is replaced with a shorter pivot stub shaft which has a circular free end portion that engages within semicircular central neck portions of the upper and lower cups. The stub shaft does not have a reduced diameter tip portion, instead the shaft simply is journaled within a bushing identical to bushing 404, which bushing is snugly engaged within a hub identical to hub 403. Accordingly, the support assembly at this end of table 20 does not include a support bracket 430, a worm gear 432, a worm, a shaft 438, or a handle 440.

Referring to FIG. 6, bed assembly 22 is held in horizontal fixed orientation relative to table frame 100 by a plurality of table latch assemblies 450 mounted within the side edge portions of bed 24 to engage with a vertically adjustable receiver plate 452, secured to side structures 102. Each assembly 450 includes a horizontally disposed blade member 454 pivotally mounted within a U-shaped bracket 456 securely disposed within a cavity formed within the side edge portions of bed 24. A circular boss extends upwardly and downwardly from the upper and lower surfaces of blade 454 to engage through close fitting openings provided in the upper and lower walls of bracket 456. A hex-shaped bore extends downwardly through blade 454 and its two circular bosses to slidably receive an Allen wrench, not shown, which can be used to rotate blade 454. Appropriate openings are provided in bed 24 and in side cushions 34 to engage the Allen wrench to reach blade 454.

Receiver plate 452 is rectangular in shape and includes a horizontally elongate slot for receiving blade 454 therethrough to thereby securely lock table assembly 22 with table frame 100. Plate 452 is mounted within recesses 170 formed in inner face wall 168 by fasteners, such as screws 458, which extend through vertically elongate slots formed in the plate to engage within inner face walls 168 of inner shell 108, FIG. 6. Slot 174 formed in inner face wall 168 provides clearance for blade 454 as the blade rotatably engages with and disengages from receiver plate 452. Also, the vertical location of receiver plate 452 can be selectively varied to adjust bed assembly 22 in true horizontal orientation.

As discussed above, table 20 is structured to enable it to be easily and conveniently transported, assembled and subsequently disassembled for movement to another location. In general, this is made possible by constructing table 20 with a minimum number of components and by providing removable ballast for the legs of the table. Ideally, the outer and inner shells 106 and 108 of side structures 102 and the outer and inner shells 302 and 304 of end structures 300 are permanently assembled together, for instance by chemical bonding.

Assembly of game table 20 can be conveniently accomplished by first bolting side stiffener plates 178 to side structures 102. Then the components of the table support assemblies are assembled within their corresponding end structures 300. Thereafter end stiffener members 338 are bolted to end structures 300. With end structures 300 and side structures 102 disposed in upside-down relationship, cap plates 348 are bolted to corresponding connection flanges 120 with capscrews 350 which engage within the connection flanges. Assembling side structures 102 and end structures 300 in upside-down relationship insures that their upper rail walls are disposed along a common plane. Forming connection flanges 120 and cap plates 348 with large bearing areas greatly assists in orientating side structures 102 and end structures 300 in "square" relationship to each other when bolts 350 are tightened. It is contemplated that no further adjustment of table frame 100 will be required to ensure that side structures 102 are parallel to each other, that end structures 300 are parallel to each other, and that the end structures are perpendicular to the side structures. Thus, special tools and expertise are not needed to properly assemble frame 100.

Once side structures 102 and end structures 300 are assembled together, frame 100 is rotated to upright position as shown in FIGS. 1–4. With the lower caps of the table support assemblies removed, bed assembly 24 is lowered within table frame 100 until the upper caps rest on the stub shaft and the drive shaft of the support assemblies. Thereafter, the lower caps of the support assemblies are simply bolted to their corresponding upper caps. Knob 440 is rotated to adjust bed assembly 22 in horizontal orientation so that latch blades 454 can be pivoted into engagement with a corresponding receiver plate 452. The vertical locations of receiver plates 452 may have to be adjusted slightly to place bed 24 in a true horizontal orientation. Lastly, leg body members 114 can be filled with appropriate ballast.

When it is desired to utilize the opposite surface of bed assembly 22, latch blades 454 are pivotally retracted from receiver plates 452 and then the bed assembly rotated 180° about its longitudinal central axis by turning handle 440. Thereafter, latch blades 454 are simply re-engaged with receiver plates 452.

As will be apparent to those skilled in the art to which the invention is addressed, the present invention may be embodied in specific forms and embodiments other than those specifically disclosed above, without departing from the spirit or essential characteristics of the invention. The particular embodiments of game table 20, described above, are therefore to be considered in all respects as illustrative and not restrictive, i.e. the scope of the present invention is as set forth in the appended claims rather than being limited to the examples of game table 20 set forth in the foregoing description.

We claim:

1. A game table comprising:

a bed assembly including;

a flat, rectangular bed having a plurality of arcuate notches in the marginal edge portions thereof; and a bumper structure extending along the perimeter of said bed;

a table frame closely surrounding and disposed substantially entirely outwardly of the perimeter of said bed assembly, said frame including;

a pair of hollow side structures disposed along and spaced slightly outwardly of the longitudinal side edge portions of said bed assembly and extending a short distance around the corresponding corners of said bed, each of said side structures including an outer shell and an inner shell engaged together to form an integral side rail, side apron, ball return run in cooperation with the adjacent side edge portion of said bed assembly, and ball storage compartment structure, and a pair of hollow end structures disposed along and spaced slightly outwardly of the end edge portions of said bed assembly to interconnect the end portions of said side structures, each of said end structures including an outer shell and an inner shell engaged together to form an integral end rail and an apron structure; and means for mounting said bed assembly on said table frame.

2. A game table according to claim 1, further comprising a generally planar, elongate side stiffening member detachably secured in face-to-face relationship to said side structure upper and lower side walls to thereby stiffen said side structure and form the inside surface of the ball run.

3. A game table, comprising:

a bed assembly including;

a flat, rectangular bed having a plurality of arcuate notches in the margins thereof; and a bumper structure extending along the perimeter of said bed;

a table frame closely surrounding said bed assembly including:

a pair of hollow side structures disposed along the longitudinal sides of said bed assembly and extending a short distance around the corresponding corners of said bed, each of said side structures including an outer shell and an inner shell engaged together to form an integral side rail, said apron, ball return run, and ball storage compartment structure, and a pair of hollow end structures disposed along the ends of said bed assembly to interconnect the end portions of said side structures, each of said end structures including an outer shell and an inner shell engaged together to form an integral end rail and an apron structure;

means for mounting said bed assembly on said table frame; and wherein each of said frame side structure outer shells includes a longitudinal portion having:

an upper rail wall extending laterally outwardly from said bed assembly to serve as the outer surface of a side rail, said upper rail wall having arcuate notches formed therein at locations corresponding to the location of said table notches;

an outer apron wall extending downwardly from the outer edge portion of said upper rail wall opposite said bed assembly to serve as the outer surface of said side apron and the outside surface of a ball storage compartment; and a base wall extending transversely inwardly from the lower edge portion of said outer apron wall toward said bed assembly, with the central portion of said lower base wall serving as the lower surface of the ball storage compartment.

4. A game table according to claim 3, wherein each of said side frame outer shells includes a pair of legs depending downwardly from said longitudinal portion.

5. A game table according to claim 4, wherein each of said legs includes:

a body portion having an exterior side wall extending downwardly from said side frame outer side wall, a pair of transverse walls extending inwardly toward the longitudinal center of said pool table from said leg exterior side wall, and a bottom wall joined to the lower edges of said leg side and transverse walls; and a removable cover serving as an interior side wall of said leg to close off said leg, said cover cooperating with said body portion to form a hollow leg construction.

6. A game table according to claim 5, wherein each of said leg body portions includes interior brace means for strengthening said leg.

7. A game table according to claim 6, wherein said brace means includes a plurality of panels which divide the interior of said leg body portion into a plurality of individual cells.

8. A game table according to claim 3, wherein each of said side frame inner shells includes:

an upper side wall extending downwardly from the adjacent edge portion of said upper rail wall;

a lower rail wall extending outwardly from the lower edge portion of said upper side wall to underlie said upper rail wall and form the lower surface of the side rail and the upper surface of the ball run, said lower rail wall having a plurality of arcuate notches formed therein, each in registry with corresponding notch formed in said upper rail wall and in said bed;

inner apron wall extending downwardly from the outer edge portion of said lower rail wall at a location spaced transversely inwardly from said outer apron wall to serve as the inner surface of the side apron and as the outer side surface of the ball return run; and an elongate ball run base wall extending transversely inwardly from the lower edge portion of said inner apron wall, said ball run base wall spaced above said lower base wall to serve as the lower surface of the ball run and the upper surface of the ball storage compartment;

a lower side wall extending downwardly from the inside edge portion of said ball run base wall opposite said inner apron wall to intersect with an adjacent edge portion of said outer base wall, said lower side wall serving as the inner side surface of the ball storage compartment; and said ball run base wall having a plurality of openings leading downwardly into the ball storage compartment located below the ball run.

9. A game table according to claim 8, further comprising:

a side tongue strip extending transversely inwardly from said outer apron wall toward said inner apron wall; and a side groove member extending transversely outwardly from said inner apron wall toward said outer apron wall, said groove member having a groove formed along its free outer edge portion opposite said inner apron wall for slidably, snugly receiving the free inward edge portions of the tongue strip to thereby interconnect said inner and outer apron walls.

10. A game table according to claim 8, wherein:

said upper and lower rail walls are arcuately notched at locations corresponding to said arcuate notches of said bed to thereby cooperatively form ball receiving pockets; and a pocket liner overlying each of said rail notches, each of said pocket liners including an arcuate upper section overlying the portion of said upper side wall disposed at said rail notches, and a lower section underlying said corresponding portions of said lower rail wall and overlying corresponding portions of said inner apron wall disposed below rail notches.

11. A game table according to claims 3 or 8, wherein:

each of said end structure outer shells includes an end rail wall extending transversely outwardly from one end of said bed assembly at an elevation corresponding to the elevation of said side structure upper rail wall, an end apron wall extending generally downwardly from the outer edge portion of said end rail wall opposite said bed assembly, and an end base wall extending longitudinally inwardly from the lower edge portion of said end apron wall at an elevation corresponding to said side structures outer base wall to terminate at an inner edge portion; and said end inner shell extends upwardly from the inner edge portion of said end base wall to intersect with a corresponding edge portion of said end rail wall to cooperate with said end structure outer shell to form a hollow box section.

12. A game table according to claim 11, wherein each of said end structures further comprises:

an end tongue strip extending transversely inwardly from said end apron wall toward a corresponding end inner shell; and an end groove member extending transversely outwardly from said end inner shell toward a corresponding end apron wall, said end groove member having a groove extending along its free end portion for slidably, snugly receiving said end tongue strip to thereby interconnect said end inner shell and said end apron wall.

13. A game table according to claim 11, further comprising a generally flat end stiffening member secured in face-to-face relationship to the surface of said end inner shell opposite said end outer shell.

14. A game table comprising:

(A) a bed assembly including:

(1) a flat, rectangular bed having a plurality of arcuate notches in the margins thereof; and (2) a bumper structure extending along the perimeter of said bed;

(B) a table frame closely surrounding said bed including;

(1) a pair of hollow side structures disposed along the longitudinal sides of said bed assembly and extending a short distance around the corresponding corners of said bed, each of said side structures including an outer shell and an inner shell engaged together to form an integral side rail, side apron, ball return run, and ball storage compartment structure;

(2) a pair of hollow end structures disposed along the ends of said bed assembly to interconnect the end portions of said side structures, each of said end structures including an outer shell and an inner shell engaged together to form an integral end rail and an apron structure;

(3) a mounting flange fixed to each end portion of each of said side structures;

(4) a cap plate disposed generally transversely to the length of and fixed to each end portion of each of said end structures; and (5) means for securing said mounting flange and a corresponding cap plate together in face-to-face relationship to thereby interconnect said end structures with said side structures; and (C) means for mounting said bed assembly on said table frame.

15. In a game table construction having a bed assembly including a rectangular bed and cushions extending along the edge portions of the bed, the improvement comprising:

a table frame for supporting the bed assembly, said frame disposed outwardly from and closely surrounding the edge portions of the bed, said table frame including:

hollow side structures extending along and spaced slightly outwardly from the side edge portions of the bed assembly and including portions defining an integral siderail, apron, ball runs in cooperation with the adjacent edge portions of the bed and ball storage compartment;

hollow end structures extending along the end edge portion of the bed assembly; and a pair of hollow leg structures integrally constructed with and extending downwardly from each of said side structures.

16. The improvement of claim 15, wherein each of said side structures includes a longitudinal portion extending along the length of said bed assembly and corner portions extending a short distance transversely from each end of said longitudinal portion toward the longitudinal center of said bed assembly to abut against an adjacent end of a corresponding end structure.

17. The improvement according to claim 15, wherein each of said end structures includes:

an end rail composed of a horizontally disposed rail wall extending transversely outwardly from a corresponding end of the bed assembly;

an end apron in the form of an upright apron outer wall extending downwardly from the outward edge portion of said rail wall opposite the bed assembly and an upright apron inner wall extending downwardly from the inward edge portion of said rail wall adjacent the bed assembly; and a base in the form of a base wall extending generally transversely between the lower edge portions of said end apron outer and inner walls to lie beneath said rail wall.

18. The improvement according to claim 17, further comprising an elongate end stiffener member secured in face-to-face relationship with the surface of said apron inner wall facing opposite said apron outer wall.

19. The improvement according to claim 17, further comprising a tongue member extending transversely from said end structure apron outer wall in a direction toward said end apron inner wall; and a groove member extending transversely from said end apron outer wall in a direction toward said end apron outer wall, said groove member having a groove extending along its free edge portion opposite said inner wall for snugly, slidably receiving said tongue member.

20. In a game table constructed having a bed assembly including a rectangular bed and cushions extending along the edge portions of the bed, the improvement comprising a table frame closely surrounding and supporting the bed assembly, said table frame including:

(A) hollow side structures extending along the sides of the bed assembly and including portions defining integral siderail, apron, ball runs and ball storage compartment;

(B) hollow end structures extending along the ends of the bed assembly;

(C) a pair of leg structures of hollow construction extending downwardly from each of said side structures; and (D) wherein each of said side structures includes:

(1) a side rail constructed from a vertically disposed upper side wall extending along the sides of the bed assembly and vertically spaced apart upper and lower rail walls extending generally transversely outwardly from the upper and lower edge portions of said upper side wall, said side rail having a plurality of spaced apart vertical notches formed therein;

(2) a side apron constructed from an outer apron wall extending generally downwardly from the outer edge portion of said rail upper wall and an inner apron wall extending generally downwardly from the outer edge portion of said lower rail wall; said inner apron wall spaced inwardly from said outer apron wall;

(3) a ball run base wall extending transversely inwardly from the lower edge portion of said inner apron wall at an elevation below said lower rail to underlie said lower rail wall;

(4) a lower side wall extending generally downwardly from the edge portion of said ball run base wall opposite said apron inner wall;

(5) an outer base wall extending transversely inwardly from the lower edge portion of said apron outer wall at an elevation spaced below said ball run base wall to intersect the lower edge portion of said lower side wall;

(6) wherein said lower rail wall, said inner apron wall, said ball run base wall and the adjacent portion of said bed assembly cooperating together to form the ball runs in communication with corresponding rail notches;

(7) wherein the central portions of said ball run base wall, said outer apron wall, said outer base wall and said lower side wall cooperating together to define a ball storage compartment at an elevation below said ball runs; and (8) wherein said ball run base wall having a plurality of openings formed therein to communicatively interconnect said ball runs with said ball storage compartment.

21. The improvement according to claim 20, wherein said ball run base wall is sloped downwardly from locations underlying said rail notches toward said openings in said ball run base wall.

22. The improvement according to claim 20, wherein said outer base wall includes:

a lower, central portion disposed below the remainder of said outer base wall to serve as a ball collection area; and inclined ramp portions interconnecting said lower central portion with the adjacent portions of said base wall to direct balls into said lower central portion.

23. The improvement according to claim 20, wherein said outer apron wall includes an opening for providing access to said ball storage compartment.

24. The improvement according to claim 20, wherein each of said side structures includes at least one inner face wall extending downwardly from the side rail upper wall to intersect with the upper edge portion of said lower side wall, said inner face wall including a horizontally elongate opening therein.

25. The improvement according to claim 24, wherein said inner face wall is disposed between adjacent ball run base wall openings.

26. The improvement according to claim 20, further comprising an elongate, generally planar side stiffener member securely attached in face-to-face relationship to the surfaces of said side structure upper and lower side walls facing opposite said outer apron wall.

27. The improvement according to claim 20, further comprising a side tongue strip member extending substantially along the entire length of and transversely inwardly from said side structure outer apron wall toward said inner apron wall; and a side groove member extending substantially along the entire length of and transversely outwardly from said side structure apron inner wall toward said apron outer wall, said side groove member having a groove formed in the outward edge portions thereof opposite said apron inner wall for slidably, snugly receiving said side tongue strip member.

28. The improvement according to claim 20, wherein each of said leg structures includes an exterior side wall extending downwardly from said outer apron wall, a pair of leg transverse walls extending downwardly from said lower base wall and extending transversely inwardly from said leg exterior side wall toward said bed assembly, a plurality of partition members extending substantially transversely from said leg exterior side wall toward the longitudinal centerline of said bed assembly to divide the interior of said leg structures into a plurality of cells; and a removable cover overlying the edge portions of said leg transverse walls opposite said leg exterior side wall.

* * * * *